United States Patent [19]

Kratzenberg et al.

[11] Patent Number: 4,533,327

[45] Date of Patent: Aug. 6, 1985

[54] APPARATUS FOR THE SUPERVISION OF A COMBAT VEHICLE, ESPECIALLY AN ARMORED VEHICLE

[75] Inventors: Wolfgang Kratzenberg, Staufenberg; Bernd Baeslack, Fuldabruck, both of Fed. Rep. of Germany

[73] Assignee: Wegmann & Co. GmbH, Kassel, Fed. Rep. of Germany

[21] Appl. No.: 502,355

[22] Filed: Jun. 8, 1983

[30] Foreign Application Priority Data

Jun. 16, 1982 [DE] Fed. Rep. of Germany ..... 3222970

[51] Int. Cl.[3] ..... G09B 9/04

[52] U.S. Cl. ..... 434/20; 434/43

[58] Field of Search ..... 434/16, 20–22, 434/43

[56] References Cited

U.S. PATENT DOCUMENTS

| | | | |
|---|---|---|---|
| 4,001,499 | 1/1977 | Dowell | 434/43 |
| 4,015,080 | 3/1977 | Moore-Searson | 434/43 |
| 4,302,191 | 11/1981 | Weibull | 434/20 |
| 4,439,156 | 3/1984 | Marshall et al. | 434/22 |
| 4,457,716 | 7/1984 | Eserhaut et al. | 434/20 |

*Primary Examiner*—Richard C. Pinkham
*Assistant Examiner*—Leo P. Picard
*Attorney, Agent, or Firm*—Sprung Horn Kramer & Woods

[57] ABSTRACT

Apparatus for the supervision of a battle vehicle, especially an armored vehicle, from a control station during training exercises. The apparatus has a television camera which is coupled to an aiming or observation apparatus in the battle vehicle and is connected by a video transmission circuit to a television receiver disposed at the control station. Outside of the battle vehicle, a television camera which can be aimed at the target area is set up in the field and can also be connected to the television receiver disposed in the control station. A remotely controlled switching device is disposed in the control station, by which either the video signal emitted by the television camera in the battle vehicle or the one emitted by the television camera set up in the field can be connected to the television receiver. The switching device is remotely operated by a firing signal transmitted from the battle vehicle.

5 Claims, 1 Drawing Figure

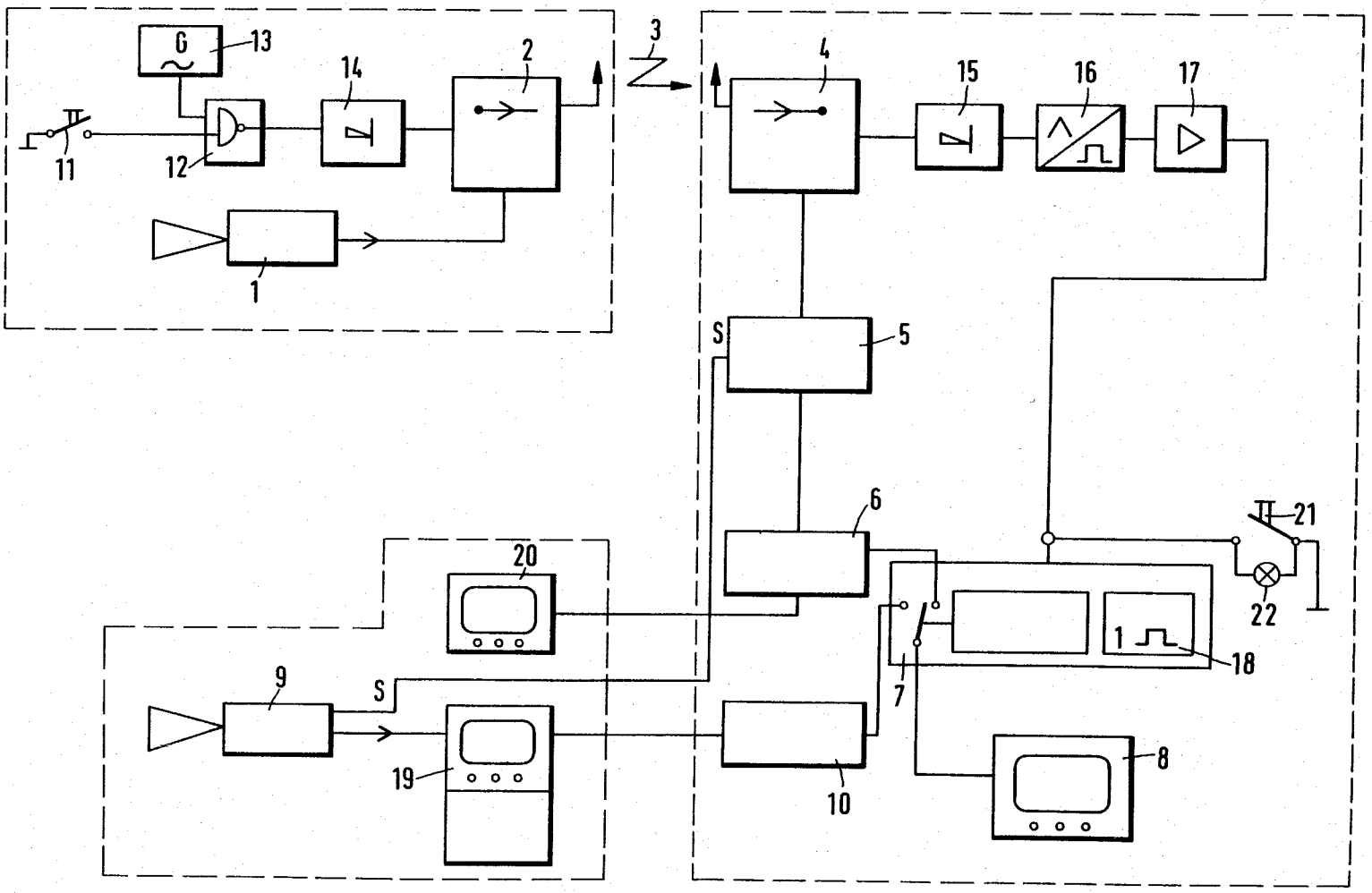
1
2
3
4
5
6
7
8
9
10
11
12
13
14
15
16
17
18
19
20
21
22
S
S

APPARATUS FOR THE SUPERVISION OF A COMBAT VEHICLE, ESPECIALLY AN ARMORED VEHICLE

BACKGROUND OF THE INVENTION

The subject matter of the invention relates to an apparatus for the supervision of a battle vehicle, especially an armored car or tank for use in training, from a control station, such apparatus including at least one television camera which is coupled by an optical adapter device to a sighting mechanism or observation unit in the battle vehicle and is connected by a video transmission system to a television receiver disposed in the control station.

With an apparatus of this kind it is possible, for example, to supervise the gunner and/or the commander during training in that the viewscreen of the television receiver disposed in the control station displays, during the entire period of use, the picture which the gunner sees through his aiming or observation apparatus, and thus the activities of the gunner can be supervised and corrected. If the commander's observation instrument is coupled with a similar television camera, it is possible by means of a remotely controlled switching device which can be operated on the basis of a given control program to transmit to the viewscreen of the television receiver in the control station either the picture from the television camera associated with the gunner or the picture of the television camera associated with the commander.

Such an apparatus is known, and described for example in DE-OS No. 30 23 517.

Now, in certain applications it has been found advantageous if the possibility is provided for viewing from the control station not only the gunner and/or commander of the vehicle or the pictures transmitted by the aiming and observation instruments they are using, but also the target area itself, so as to identify the placement of hits during practice gunnery.

The problem to which the invention was addressed was to design the apparatus of the type mentioned above so as to make it possible to observe not only one or more operators of the vehicle but also the target area, and to do so selectively and alternatively at given intervals of time on the basis of certain given criteria.

SUMMARY OF THE INVENTION

This problem is solved in accordance with the invention wherein outside of the battle vehicle, a television camera which can be aimed at the target area is fixedly set up in the field, and is connected by a cable or by a second video link to a television receiver disposed in the control station. In the control station there is disposed a remotely controllable switching device by which either the video signal originating from the television camera of the battle vehicle or the one originating from the television camera fixedly set up in the field is connected to the television receiver disposed in the control station, the switching device being actuated by a firing signal transmitted via the video transmission system from the battle vehicle. Apparatus is disposed in the battle vehicle for the processing of the electrical firing impulse, for the production of the firing signal and for the transmission thereof to the video transmission system.

In the apparatus of the invention, therefore, the target area is directly observed by a television camera that is set up at a given point in the field and can be aimed at the target area. This additional television camera can be connected to the control station either by a cable or, if it is to be at least sometimes mobile, by a second video transmission system. The automatic switching apparatus disposed at the control station brings it about that, when a shot is fired, the direct image of the target area automatically appears on the viewscreen of the television receiver in the control station, instead of the picture transmitted from the aiming or observation apparatus in the battle vehicle. In this manner it is possible during practice gunnery to have precise supervision not only of the aiming process and of the preparation for firing, but also of the placement of the hits after the shot has been fired.

Advantageous embodiments of the apparatus of the invention are within the scope of the invention. For example, the television camera fixedly set up in the field is preferably equipped with a telescopic lens.

In another preferred embodiment, the television camera fixedly set up in the field and an observation monitor connected therewith are disposed in a target observation separate from the control station. Additionally, in the target observation station, an additional observation monitor is disposed, which is connected to the television camera.

In a further preferred embodiment, the switching device is connected to a timing device by which, after the switching of the video signal emitted from the television camera fixedly set up in the field to the television receiver, on the basis of a firing signal, after a preselectable span of time a reverse switching of the video signal emitted by the television camera of the battle vehicle to the television receiver is produced.

It is furthermore possible to connect the apparatus of the invention not only to the apparatus described in DE-OS No. 30 23 516 but also to other apparatus developed for the supervision of a battle vehicle with which it is possible in training exercises not only to supervise the actions of the gunner and/or of the commander but also to insert the elevation and azimuth of the weapons and/or the momentary systems data of the weapon system into the picture appearing on the viewscreen of the television receiver in the control station. Such apparatus are described, for example in DE-OS No. 30 23 518, DE-OS No. 30 23 517 and DE-OS No. 30 23 553.

An embodiment of an apparatus of the invention will be further explained herein with the aid of the appended drawing.

BRIEF DESCRIPTION OF THE DRAWING

The FIGURE represents a block diagram of the entire apparatus in an armored battle vehicle, a control station, and a target observation station.

DETAILED DESCRIPTION OF THE INVENTION

In the apparatus represented, a television camera 1 identified as "Camera I" is linked by an optical adapter to an aiming device, which is not shown, on the armored vehicle. The television camera 1 is connected to a telemetry transmitter 2 disposed on the armored vehicle. The transmitter is connected by the radio transmission system 3 to a telemetry receiver 4 disposed in the control station.

In the manner not represented, still another television camera can be coupled with another aiming or observation device and can be connected to the telemetry transmitter 2 by a switching device which also is not represented.

The telemetry receiver 4 is connected by a synchronizing separator 5 and a video signal processor 6 to the television receiver 8 in the control station, which can be a monitor with a large viewscreen, for example.

A television camera 9 identified as "Camera II" and equipped with a telescopic lens is set up in the field. This television camera 9 can be aimed at the target area. For this purpose it is connected to an observation monitor 19 provided at the target observation station. Furthermore, it is connected by a cable and a video signal processor 10 disposed in the control station to the remotely controlled switching device 7. If the television camera 9 is also disposed on a vehicle that can be driven over the terrain, for example, it is fundamentally possible to transmit the video signal from the television camera 9 set up in the field to the control station via its own video link.

Furthermore, still another observation monitor 20 can be provided at the target observation station. This monitor is connected by a cable to the apparatus 6 for the processing of the video signal delivered by the television camera 1, so that in the target observation station the pictures delivered by the two television cameras 1 and 9 can be observed and used for the adjustment of television camera 9.

The switching device 7 is operated automatically from the armored vehicle when the shot is fired. When the firing button 11 is pressed, a signal produced by an osciallator 13 is delivered through an AND circuit 12 and a modulator 14 to the telemetry transmitter 2. The telemetry receiver 4 in the control station is connected by a demodulator 15, a pulse former 16 and an amplifier to the control input of the switching device 7. A time period of, for example, 2 and 10 seconds can be preset on a timing circuit 18 also connected to the switching device. When the firing button 11 is depressed, a firing signal is transmitted through the video link 3, and the switching device 7 performs a switching action on the basis of which it is not the picture delivered by the television camera 1 on the armored vehicle that appears on the viewscreen on the television receiver 8, but the picture delivered by the television camera in the field, which remains for the preselected time span of 2 to 10 seconds. At the end of this period the switch is changed over and again it is the picture delivered by the television camera 1 on the armored vehicle that appears on the viewscreen of the television receiver 8. The preparation and firing of the shot can be supervised from the control station until these operations have been completed, and then, on the basis of the automatic switching, to observe the location of the hit on the terrain.

By means of a button 21 it is furthermore possible to perform from the control station a direct operation of the switching device 7, in order to check the aim of the television camera 9 at the target area. A signal light 22 indicates that the switching has been performed.

It will be appreciated that the instant specification and claims are set forth by way of illustration and not limitation, and that various modifications and changes may be made without departing from the spirit and scope of the present invention.

What is claimed is:

1. In an apparatus for supervising an armored battle vehicle from a control station during training in the field, the apparatus having a firing switch for producing a firing signal, at least one first television camera which is optically coupled to an aiming device in the vehicle and which produces a first video output signal, a television receiver disposed in the control station and means for transmitting the output signal of the first camera to the control station, the improvement comprising: a second television camera for producing a second video output signal and disposed in a stationary location outside of the vehicle in the field and aimed at a target area; means conducting the second video output signal to the control station; means for effecting transmission of the firing signal to the control station by the transmitting means; and remotely controllable switching means disposed in the control station and actuated by the firing signal for applying either the output signal from the first camera or the output signal from the second camera to the television receiver in the control ration.

2. The apparatus of claim 1, wherein the second television camera is equipped with a telescopic lens.

3. The apparatus of claim 1, further comprising an observation monitor connected to the second television camera and wherein observation monitor and second camera are disposed in a target observation station separate from the control station.

4. The apparatus of claim 3, further comprising an additional observation monitor in the target observation station and means connecting same to the output of the first television camera.

5. The apparatus of claim 1, wherein the switching means normally applies only the output signal from the first camera to the television receiver and in response to the firing signal applies only the output signal emitted from the second television camera in the field to the television receiver and wherein the switching means further includes timing means for applying only the output signal of the first camera to the television receiver at a predetermined time after the firing signal.

* * * * *